US005835455A

United States Patent [19]

Hanson et al.

[11] Patent Number: 5,835,455

[45] Date of Patent: Nov. 10, 1998

[54] AUDIO PRESCRIPTION INSTRUCTION DEVICE

[75] Inventors: E. Christine Hanson; David R. Work, both of Chapel Hill; Scott D. Elliott, Cary; Michael S. Cobb, Raleigh, all of N.C.

[73] Assignee: University of North Carolina - Chapel Hill, Chapel Hill, N.C.

[21] Appl. No.: 726,860

[22] Filed: Oct. 4, 1996

Related U.S. Application Data

[63] Continuation of Ser. No. 153,774, Nov. 17, 1993, abandoned.

[51] Int. Cl.[6] ..... G04B 47/00; G04C 21/32; A47B 67/02

[52] U.S. Cl. ..... 368/10; 368/63; 221/2

[58] Field of Search ..... 368/10, 69, 72–74, 368/250, 251; 221/2, 3, 15; 364/569

[56] References Cited

U.S. PATENT DOCUMENTS

| | | | |
|---|---|---|---|
| 4,405,241 | 9/1983 | Aihara et al. | 368/63 |
| 4,406,549 | 9/1983 | Takahashi | 368/63 |
| 4,408,096 | 10/1983 | Washizuka et al. | 368/107 |
| 4,419,016 | 12/1983 | Zoltan | 368/10 |
| 4,449,829 | 5/1984 | Ikemoto et al. | 368/63 |
| 4,725,997 | 2/1988 | Urquhart et al. | 368/10 |
| 4,748,600 | 5/1988 | Urquhart et al. | 368/10 |
| 4,768,176 | 8/1988 | Kehr et al. | 368/10 |
| 4,768,177 | 8/1988 | Kehr et al. | 368/10 |
| 4,970,669 | 11/1990 | McIntosh et al. | 364/569 |
| 5,014,798 | 5/1991 | Glynn | 177/25 |
| 5,099,463 | 3/1992 | Lloyd et al. | 368/10 |
| 5,170,380 | 12/1992 | Howard et al. | 368/10 |
| 5,387,108 | 2/1995 | Crowell | 434/319 |

*Primary Examiner*—Vit W. Miska
*Attorney, Agent, or Firm*—Jenkins & Wilson, P.A.

[57] ABSTRACT

A reprogrammable device for removably receiving a medicine container and for providing audio instructions to a patient for taking a medication. When a medicine container is removed from the device by the patient so that the patient may take the medicine, the device can be activated to play a pre-recorded individualized message from the pharmacist providing the patient audio instructions for taking the medication.

4 Claims, 3 Drawing Sheets

AUDIO PRESCRIPTION INSTRUCTION DEVICE

This is a continuation of application Ser. No. 08/153,774 filed on Nov. 17, 1993, now abandoned.

Technical Field

The present invention relates in general to the dispensing of pharmaceutical preparations. More particularly, the invention relates to a reprogrammable drug dispenser instruction system, to provide to the patient individualized programmed audio instructions for administration of a pharmaceutical preparation.

RELATED ART

Generally, prescription labels on medicine bottles contain typed instructions informing the patient how to take the medication contained in the bottle. Instructions usually include information such as how often to take the medication, whether prolonged exposure to direct sunlight should be avoided, whether the medication should be taken with food or on an empty stomach, and whether the medication is for administration other than orally (such as for administration via the rectum, the ear, etc.). Such information is typically written at the 4th to 6th grade level.

However, many people are functionally illiterate or have a low literacy ability (both kinds of persons being herein referred to as "reading impaired"), and therefore have problems understanding how to adhere to their medication instructions. Additionally, since the labels are typed with small letters, visually impaired people with poor eyesight will have difficulty in reading the instructions on the labels. Of course, people who are blind cannot read the labels, regardless of the letter size. Accordingly, these reading impaired and/or visually impaired people may be unintentionally non-compliant with the medication instructions that the pharmacist places on the label on the prescription bottle, as they have to rely on recall of the pharmacist's oral instructions from the time they purchased the medication.

Non-compliance has several adverse results, two of the most obvious being over-utilization and under-utilization of medication. Under-utilization of prescription medications can lead to inadequate treatment, which may increase disease severity and or longevity. Over-utilization of prescription medications has been shown to lead to increased hospitalizations, especially for the elderly.

Of interest with respect to a system for dispensing pills from a medicine bottle is U.S. Pat. No. 5,014,798 to Glynn (assigned to Tenax-Glynn Corporation). This patent is directed to a cap for a medicine bottle for monitoring a patient's medicine compliance. The cap disclosed includes a weight scale connected to a computer chip with a display unit also located on the cap. Results of compliance or non-compliance are shown on the display, which is preprogrammed for a specific prescription (see FIG. 3 of the patent). Alternatively, an audio signal, such as an electronic voice, could be utilized to warn the patient of deviation from the dosage as per the prescription instructions.

Also of interest are U.S. Pat. Nos. 4,768,176 (parent) and 4,768,177 (continuation-in-part) both to Kehr. et al. These patents are directed to a device having multiple compartments in which prescription medication is stored. The device incorporates suitable chip circuitry in order to provide signals indicating: (1) that the medication should be taken; (2) from which of the multiple compartments the medication should be taken; (3) the quantity of medication to be taken from the designated compartment; and (4) instructions for taking the medication. The disclosed circuitry may serve to actuate a voice synthesizer or to start a recording, which would emit audible voice instructions to the patient describing how to take the medication.

Of further interest are U.S. Pat. Nos. 4,725,997 (parent) to Urquhart et al. and 4,748,600 (continuation-in-part) to Urquhart (both assigned to Aprex Corporation). These patents are also directed to a device having multiple compartments for storing medication. The device actively controls the pattern in which doses of one or more of the medications are administered to the patient by utilizing suitable chip circuitry. The circuitry is initially programmed with dosing regimen information. Thus, based on pre-calculated deviations, the device may dispense or withhold medication depending on whether or not the patient has deviated from the regimen. Also, the device is adapted to warn the patient by use of an audio or visual signal regarding whether a dose of medication may be taken at the time the patient desires. Additionally, an alternative embodiment of the device instructs the patient by means of an audio or visual message with respect to special conditions for taking the medication.

DISCLOSURE OF THE INVENTION

In accordance with the present invention, applicants provide a device for providing instructions for taking medication. The device comprises a housing unit for receiving at least one medication container, means for receiving an audio message, reprogrammable computer means, actuation means, means for emitting an audio message, and power source means. The computer means is electrically connected to the means for receiving an audio message, and is adapted for storing and transmitting the message for replay. The means for emitting an audio message is electrically connected to the computer means, and the actuation means is electrically connected to the computer means for selectively actuating the computer means so as to cause the stored audio message to be transmitted to the emitting means. Lastly, the power source means is electrically connected to the computer means for providing electrical power thereto. In one embodiment of the invention, removal of the medicine container from the housing unit actuates the computer means. In another embodiment, the computer means is selectively actuated by pressing a button in the housing unit.

Furthermore, in accordance with the present invention, applicants provide in combination a medication container and an audio medication instruction device. The audio medication instruction device comprises means for receiving an audio message, reprogrammable computer means, actuation means, means for emitting an audio message, and power source means. The computer means is electrically connected to the means for receiving an audio message, and is adapted for storing and transmitting the message for replay. The means for emitting an audio message is electrically connected to the computer means, and the actuation means is electrically connected to the computer means for selectively actuating the computer means so as to cause the stored audio message to be transmitted to the emitting means. Lastly, the power source means is electrically connected to the computer means for providing electrical power thereto.

It is therefore the object of the present invention to provide a device for housing a medication container and for recording personalized medication instructions to a patient wherein the device will provide upon demand an audio reiteration of the medication instructions to the patient.

Accordingly, it is a feature of the present invention that persons who are illiterate or of low literacy and or who are visually impaired will be able to hear previously recorded personalized medication instructions thereby obviating the problem of inability to read printed instructions on a label on a pill vial.

Some of the objects, features, and the like of the invention having been stated hereinabove, other objects will become evident as the description proceeds, when taken in connection with the accompanying drawings as best described hereinbelow.

BRIEF DESCRIPTIONS OF THE DRAWINGS

BEST MODE FOR CARRYING OUT THE INVENTION

Figure 1:
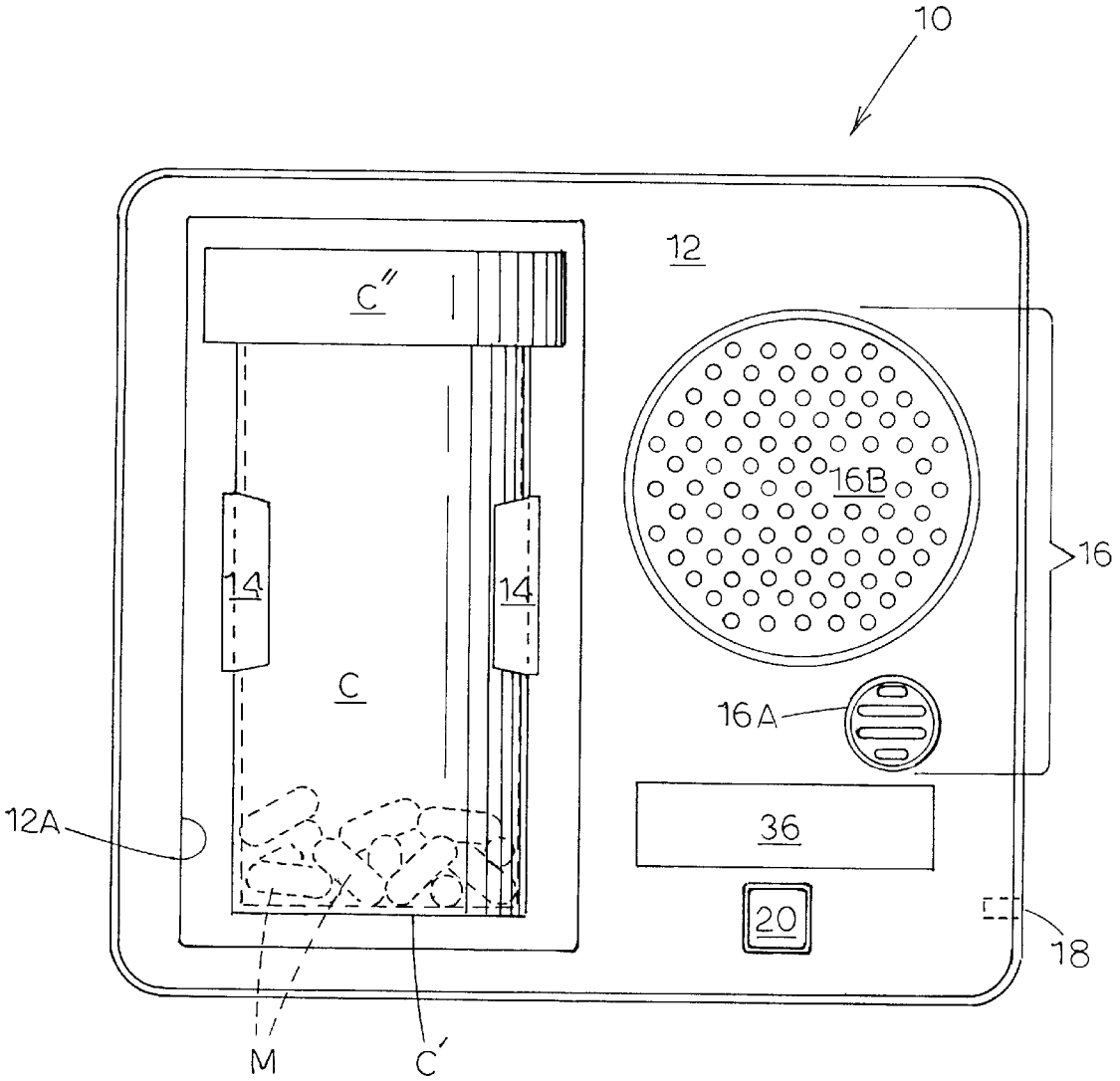
FIG. 1 is a top plan view of the device of the present invention, illustrating a housing in which a medicine vial is disposed.
Figure 2:
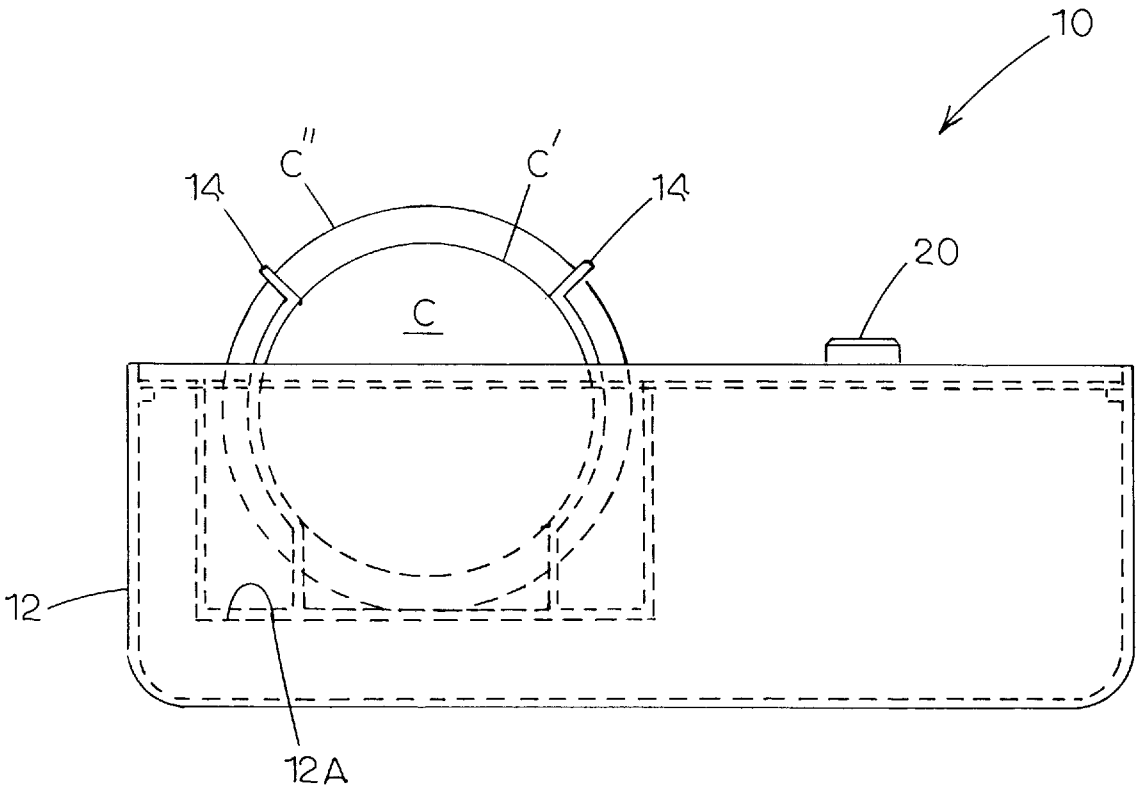
FIG. 2 is an end elevational view of the device of FIG. 1, including a medicine vial.
Figure 3:
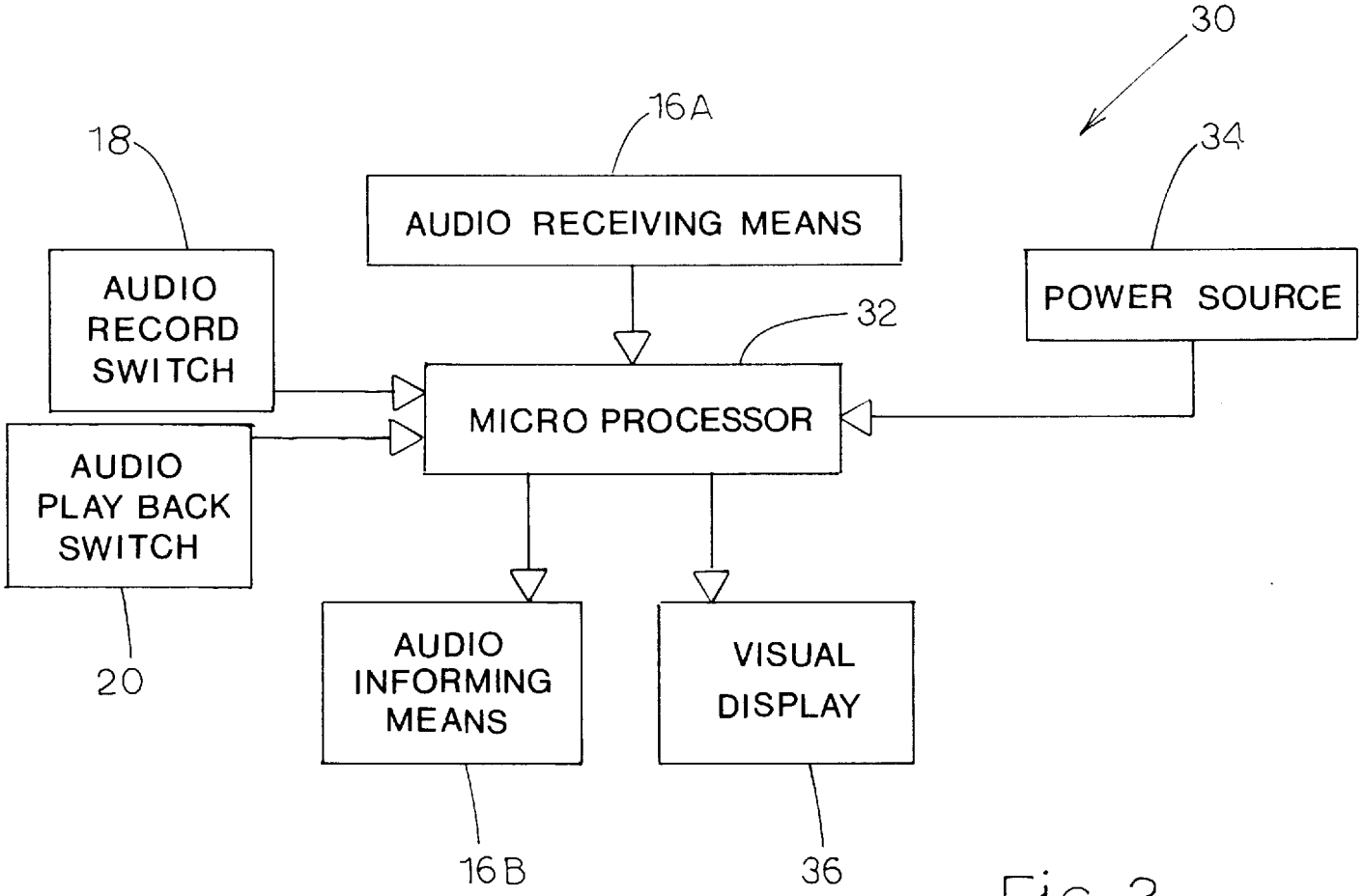
FIG. 3 is a schematic block diagram representation of the circuitry for the device shown in FIGS. 1 and 2.

Referring now more specifically to the drawings, a preferred embodiment of the medication instruction device according to the present invention is illustrated in FIGS. 1–3 and generally designated 10. Device 10 includes housing unit 12 defining a cavity 12A therein for receiving a medicine container. Housing unit 12 is shown with holders 14 to assist in holding a medicine container C, such as a vial or bottle. Container C includes a receptacle portion C' for holding tablets, pills or the like, and a cap portion C" for closing receptacle portion C'. Container C is illustrated containing medication pills M disposed inside thereof.

As illustrated in FIG. 1, device 10 also includes audio informing means 16. In one embodiment, the audio informing means 16 may include separate means for receiving an audio message, such as microphone 16A, and separate means for emitting an audio message, such as transmitter or speaker 16B. Alternatively, the audio informing means 16 may be unitary, wherein the means for receiving an audio message is also the means for emitting an audio message. The audio informing means 16 (and all other electronic elements of device 10 as described hereinafter) may be conveniently mounted on an electronic circuit board (not shown) or electrically connected thereto by suitable circuitry in a manner well known in the electrical arts.

A pin hole-type switch 18 is provided in housing 12 by which a pharmacist can program or reprogram a suitable microprocessor utilized by device 10, and a push button-type switch 20 is provided by which a patient can repeatably upon demand play the prescription instruction message recorded on the microprocessor. The microprocessor is most suitably a "voice chip" record play back device such as Part No. ISD2545G available from Information Storage Devices of San Jose, Calif. and capable of recording up to 45 seconds of audio message.

The electronic circuitry 30 utilized by device 10 is schematically illustrated in FIG. 3. A computer means is illustrated as microprocessor 32, adapted for receiving and storing a medication instruction message from microphone 16A for replay. Microprocessor 32 acts to process and store the information that a pharmacist inputs subsequent to actuating switch 18 (with a pen point or the like) and then upon demand by a patient to output that information to speaker 16B to be heard by the patient (or user). Microprocessor 32 is electrically connected to power source 34, most suitably a battery within device 10, and to pin hole-type switch 18 and push button-type switch 20. Microprocessor 32 is reprogrammable such that a recorded and retrieved message can be erased and a new message recorded and retrieved.

In a preferred embodiment of the invention, removal of medicine container C from device 10 actuates microprocessor 32. For instance, when the patient removes container C from housing 12, the holders (illustrated as clips 14) which retain container C in housing 12, will serve to actuate audio play back switch 20 and thereby microprocessor 32 so that the message recorded thereon will play back to the patient (or, alternatively, clips 14 could be connected to a separate audio play back switch).

In another embodiment of the invention, clips 14 serve simply to assist in holding container C in place in housing 12, and removal by the patient of container C does not actuate the play back of the recorded and stored message. Rather, when the patient removes container C in order to take medication therefrom, the patient then activates button switch 20 (illustrated in FIG. 1), as many times as desired, as the means for playing back the message previously recorded and stored in microprocessor 32 of device 10.

In another embodiment of the invention, both button switch 20 and clips 14 may serve to actuate said audio play back switch 20, in the event that the patient wants to hear the message one or more times again after initial removal of medicine container C from housing 12.

Optionally, device 10 may also have a visual display screen 36 for providing a visual readout (e.g., LCD or LED) of the medication instructions that the patient can view. Although device 10 is primarily intended for persons who are reading impaired and/or visually impaired, persons who can read and see may desire this embodiment of device 10 with visual display screen 36 so that they can both hear their medication instructions and read their medication instructions.

In yet another alternative embodiment of the invention, applicants do not contemplate a separate housing 12 for medicine container C and thus the electronic circuitry of FIG. 3 for providing the audio medication instructions is provided in medication container C itself. Most suitably, either the receptacle portion C' or the cap portion C", could be adapted to contain the audio medication instruction circuitry described hereinbefore and capable of being incorporated into a small space as is well known to those skilled in the electrical arts.

Furthermore, it is noted that although the invention is primarily intended for prescription medications, it could be employed with over-the-counter drugs. For instance, many elderly people who have arthritis are told by their doctors to take an over the counter medication a certain number of times per day rather than the doctor prescribing a prescription medication for the arthritis pain. In that event, the pharmacist could place the over the counter tablets inside a vial designed to be employed in accordance with the invention.

It will be understood that various details of the invention may be changed without departing from the scope of the invention. Furthermore, the foregoing description is for the purpose of illustration only, and not for the purpose of limitation — the invention being defined by the claims.

What is claimed is:

1. A reprogrammable device for housing at least one medication container and recording and playing human audio instructions for taking said medication, comprising:

(a) a pocket size unitary housing comprising:

(i) said at least one medication container comprising a vial portion and a cap portion, the housing further comprising a U-shape retaining clip surrounding greater than 50% of the circumference of said medication container for releasably retaining the medication container in the housing;

(ii) means for receiving a human audio message;

(iii) reprogrammable computer means electrically connected to said means for receiving a human audio message, and for storing and transmitting said message for replay;

(iv) a recessed switch mounted on said housing for programing or reprogramming the computer means;

(v) means for emitting a human audio message electrically connected to said computer means;

(vi) manual actuation means electrically connected to said computer means for a human to selectively actuate said computer means so as to cause said stored human audio message to be transmitted to said means for emitting, said actuator means consisting of both said U-shape clip and a push button switch mounted on said housing wherein either removal of said medication container or manual activation of said push button switch will serve to cause the stored message to be transmitted to said means for emitting;

(vii) a battery electrically connected to said computer means for providing electrical power thereto; and (b) said device defining a pocket size for insertion into a clothing pocket of a human user for portable use of said device.

2. The device of claim 1, wherein the actuation means comprises retaining means for releasably retaining the medication container in the housing, and which, when a human manually removes the medication container, actuates said computer means.

3. The device of claim 1, wherein the recessed switch is a pin-hole type switch.

4. The device of claim 1 wherein the housing further comprises a cavity, said cavity having a capacity for receiving the medical container, and where the retaining clip is mounted within the cavity.

* * * * *